United States Patent [19]

Acson et al.

[11] Patent Number: 4,531,310

[45] Date of Patent: Jul. 30, 1985

[54] DISPLAY ELEMENT

[75] Inventors: Paul Acson, Ft. Lauderdale; Anthony Esposito, Coral Springs, both of Fla.

[73] Assignee: Futures Unlimited, Inc., Ft. Lauderdale, Fla.

[21] Appl. No.: 569,756

[22] Filed: Jan. 10, 1984

[51] Int. Cl.[3] ..... A44C 3/00

[52] U.S. Cl. ..... 40/1.5; 40/455

[58] Field of Search ..... 40/455, 1.5; 84/1.01

[56] References Cited

U.S. PATENT DOCUMENTS

| | | | |
|---|---|---|---|
| 3,407,523 | 10/1968 | Winston | 40/1.5 |
| 3,927,375 | 12/1975 | Lanoe et al. | 40/1.5 |
| 4,184,321 | 1/1980 | Tarusawa | 368/281 |

FOREIGN PATENT DOCUMENTS

| | | | |
|---|---|---|---|
| WO81/02215 | 8/1981 | PCT Int'l Appl. | 40/455 |

*Primary Examiner*—Robert Peshock
*Assistant Examiner*—Cary E. Stone
*Attorney, Agent, or Firm*—John H. Faro

[57] ABSTRACT

An improved device for communication of graphic and/or pictorial information. In its simplest form, this device includes a graphic and/or pictorial information display element, a synthesizer element for electronic sound reproduction and a backing plate which couples to the display element and thereby defines a chamber for housing the synthesizer. The audible message produced by the synthesizer can be programmed for enhancement and/or complementary to the graphic and/or pictorial information depicted on the display element. This device can be used as a novelty item, jewelry-like adornments, enhanced security identification badges and various instructional and/or message oriented media.

12 Claims, 8 Drawing Figures

DISPLAY ELEMENT

BACKGROUND OF THE INVENTION

1. Field of the Invention

This invention is directed to apparatus. More specifically, this invention concerns itself with an improved device for communication of graphic and/or pictorial information having audible enhancement of such information.

2. Description of the Prior Art

The use of micro-electronics to produce visual and audible enhancement in watches, calculators and more recently in greeting cards, is well known.

For example, light emitting diodes have been previously coupled to micro-electronic circuitry in wristwatches (U.S. Pat. No. 3,901,121) and in articles of adornment (U.S. Pat. No. 3,918,184). The wristwatch described in the '121 patent incorporates a free-running multivibrator which can be preset to activate its light emitting diodes at a certain frequency, thereby providing a visible pacing function (i.e., a metronome). The article described in the '184 patent is similar in its construction and simply intended to enhance the visibility of the message carrier within which it is incorporated.

The use of synthesizers for the electronic recreation of musical notes and voice messages is also well established in the art. Typically, music synthesizers are being used today in various devices, see for example U.S. Pat. Nos. 4,080,862; 4,082,027; 4,085,644; 4,085,648; and, 4,098,162. Such devices are routinely used in the composition of music which can, in certain instances, be recorded on magnetic tape within the same device. Other uses for such synthesizers include the musical accompaniments now being incorporated within certain greeting cards.

The use of voice synthesizers is also prevalent in many scientific and educational devices, i.e., calculators and the Texas Instruments-"Speak and Read", "Speak and Say" and other similar systems. The voice enhancement of these devices is intended to simplify their use, and in the case of educational devices to provide prompting and/or reenforcement for the user.

In virtually all of the applications described above, with the exception of greeting cards, the use of sound synthesizer technology in consumer products is still limited to rather specialized areas and to many higher cost items. Sound enhancement of various devices has thus, up to now, proven either impractical or incompatible with many of the more common items which find their way into the consumer household.

OBJECT OF THIS INVENTION

It is the object of this invention to remedy the above as well as related deficiencies in the prior art.

More specifically, it is the principal object of this invention to provide a self-contained portable device for communication of graphic and/or pictorial information which provides sound enhancement of such information.

It is another object of this invention to provide an improved information delivery system combining both visual and audible messages.

It is yet another object of this invention to provide an improved security identification system combining both graphic and/or pictorial information with an audible coded message.

It is still yet another object of this invention to provide an improved information delivery system combining both visual information and audible messages which can be up-dated or changed depending upon circumstances and/or events.

Additional objects of this invention include providing novelty items and articles of adornment having both graphic and/or pictorial information combined with sound enhancement.

SUMMARY OF THE INVENTION

The above and related objects are achieved by providing a graphic and/or pictorial information communication device having audible enhancement of the graphic and/or pictorial information. The term "enhancement", as used in the foregoing context, is intended as inclusive of audible information which is explanatory, complementary or supplementary to the visual information which is graphically and/or pictorially displayed on such device. In its simplest form, this device can comprise an element for display of the graphic and/or pictorial information; a backing element or plate, which couples to the non-information bearing side of the display element, thus defining a chamber therebetween; a sound synthesizer along with associated power source and speaker operatively disposed relative to one another within said chamber; switching means for selective activation of the sound synthesizer; and, means associated with the exposed surface of the backing element for attachment of the device to another surface or to a wearer. In the preferred embodiments of this invention, access is provided to the power supply of the synthesizer through either an access window in the backing element, or by decoupling the backing element from the display element. In another of the preferred embodiments of this invention, the graphic and/or pictorial information can be readily altered and/or replaced with up-dated or alternative information through an access slit along the edge of the display element. Similarly, the audible output of the synthesizer can be modified through the use of interchangeable integrated circuits which can be simply unplugged from the printed circuit board of the synthesizer assembly and replaced with another integrated circuit carrying a different coded set of message instructions.

DESCRIPTION OF THE INVENTION INCLUDING PREFERRED EMBODIMENTS

Figure 3:
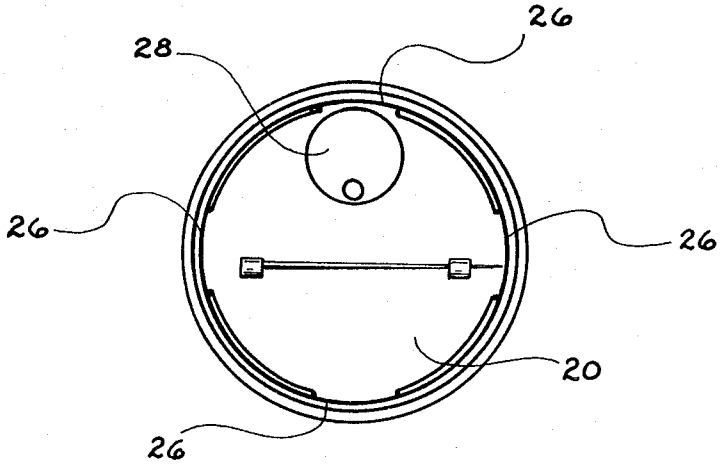
FIG. 3 is a exploded view, in partial perspective, of the device illustrated in FIG. 2.

The following description of this invention is made with reference to one or more of the preferred embodiments as illustrated in the accompanying drawings. Elements which are common to each of the foregoing figures are assigned a common reference numeral.

Figure 2:
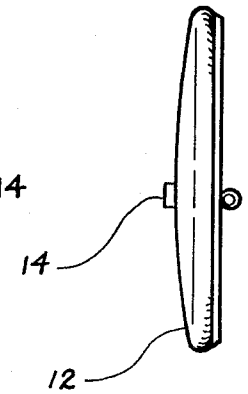
FIG. 2 is a rear view of the device illustrated in FIG. 1.
Figure 1:
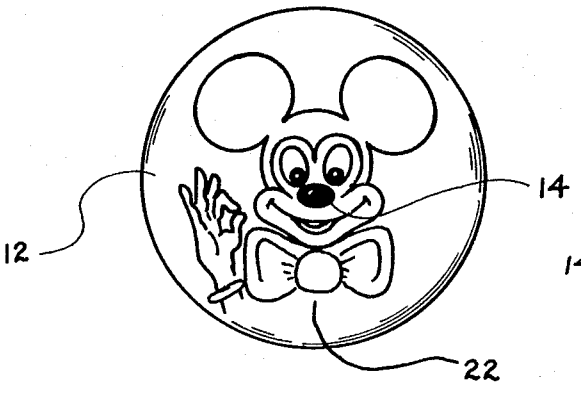
FIG. 1 is a frontal view of one of the preferred embodiments of the device of this invention.

In FIGS. 1 and 2 are illustrated a representative embodiment of the device of this invention in its simplest form. The device 10 illustrated therein is essentially a circular button having a pictorial illustration of a cartoon character. The display side of face member 12 of the device comprises an essentially convex surface having button switch 14 operatable from the display side of said face member (and integrated within the pictorial image), for activation of sound synthesizer 16. The sound synthesizer assembly 16 is positioned within chamber 18 defined by the concave surface of the display member and backing plate 20. The switching member 14 can also be located elsewhere on the button and can take anyone of a number of convenient and readily available forms. For example, where the graphic and/or pictorial information does not readily lend itself to unobtrusive integration of a button-like switch on the face of the display element, a flat switching means (i.e., a membrane switch) located under the graphic and/or pictorial information can be readily incorporated into the device of this invention. Alternatively, the switching means can be relocated to the back of the device or placed at the periphery, or at the junction of coupling of the display member to the backing plate.

Under certain conditions, it may also be desirable to provide perforations 22 within the face of the display member of this device to enhance the projection of the audible message from the sound synthesizer. Such perforations should also preferably be unobtrusively incorporated into the pictorial and/or graphic information contained on the display member. Alternatively, the speaker component of the sound synthesizer can be mounted directly on the concave surface of the face member, thus converting the display element into a resonator.

Figure 4:
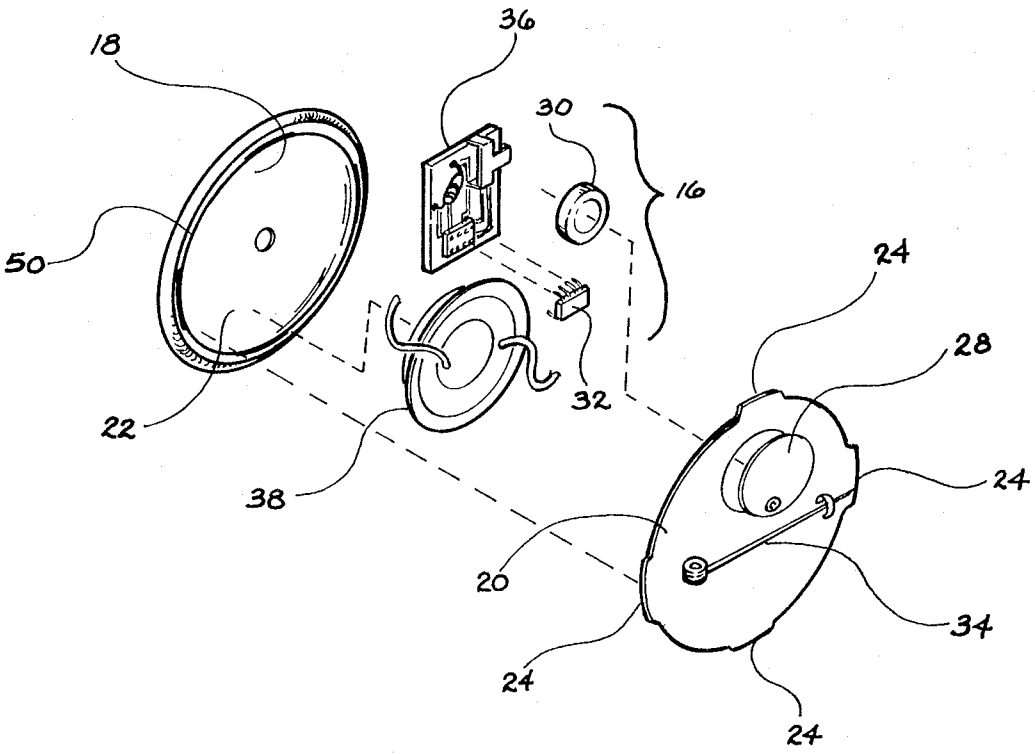
FIG. 4 illustrates the adaptation of the device of this invention as a belt buckle.
Figure 8:
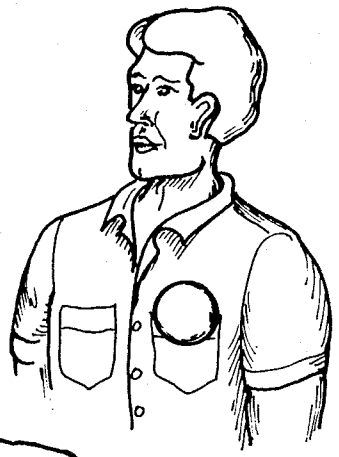
Figure 7:
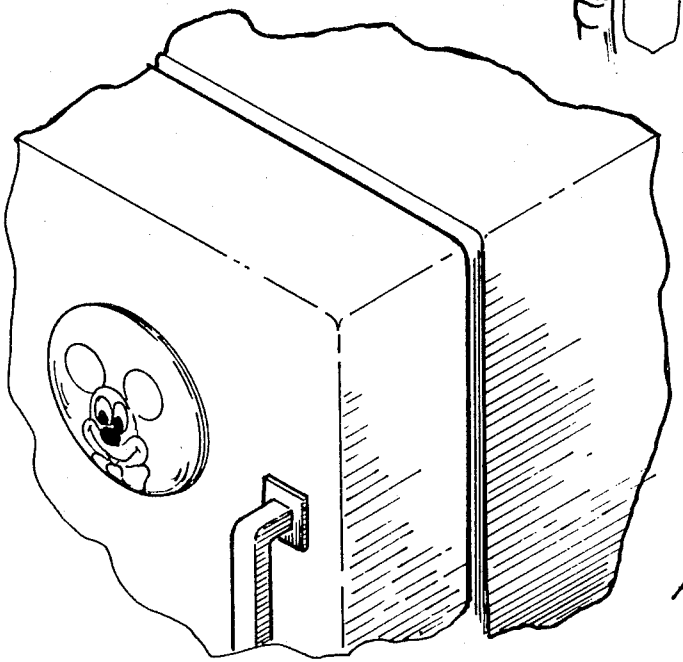
Figure 6:
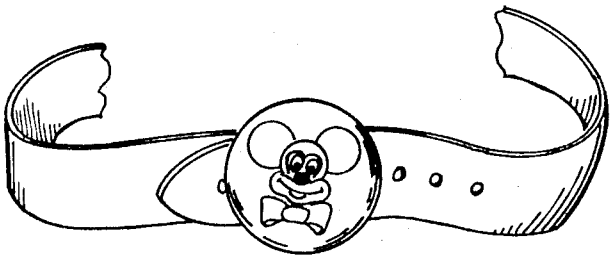
FIG. 6 illustrates the adaptation of the device of this invention with means for attachment to a metallic surface.
Figure 5:
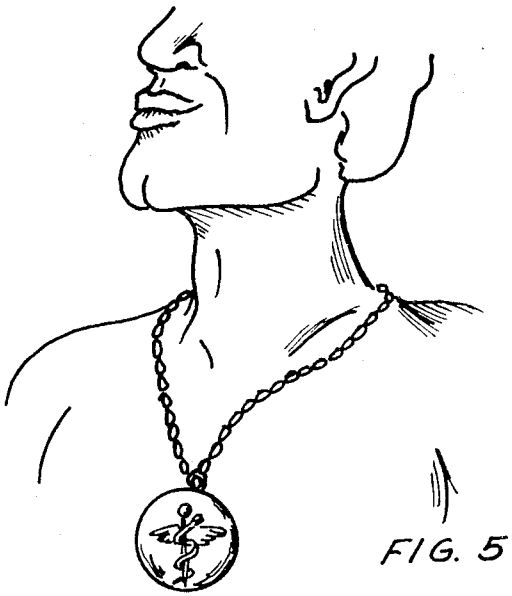
FIG. 5 illustrates the adaptation of the device of this invention as a pendant.

As illustrated in FIG. 4, the backing plate 20 of the display device is provided with a series of tabs 24 which are designed to couple with a series of corresponding slots 26 provided along the inside of the lip at the periphery of the display element. In the device which is illustrated in FIG. 4, the pictorial information if laminated to the display member and the lamination permanently affixed by insertion of a second element 50 which matingly engages with the backside of the display member. The backing plate, which can be attached to the display member, can either be permanently coupled thereto, or, as shown in FIG. 4, removable. Where the backing plate is permanently attached, an access window 28 is generally provided to permit servicing of the synthesizer assembly (i.e., replacement of batteries 30) and/or the replacement or substitution of a new integrated circuit 32 (computer on a chip). In the design of the backing plate of this device which is illustrated in both FIGS. 3 and 4, both limited and complete access to the chamber housing the sound synthesizer is contemplated. The backing plate is also provided with a conventional pin-type clasp 34 for attachment of the display device to an item of apparel or other comparable surface. In addition to, or as an alternative to this type of clasp, means can be provided to permit the use of this device as a pendant (as shown in FIG. 5); as a belt buckle (as shown in FIG. 6); or, to a hard surface (through magnetic or adhesive attachment as shown in FIG. 7). FIG. 8 is a further adaptation of the device of this invention to provide a coded audible message for an identification badge.

FIG. 4 depicts an exploded view of the sound synthesizer assembly upon removal of the backing plate of the device shown in FIGS. 1 and 2. In its simplest form, the assembly comprises four (4) basic subassemblies, or five (5) in the case of a speech synthesizer:

i. a printed circuit board 36 having various capacitive, resistive and amplification components and filters, operatively prearranged and connected to one another in a defined electrical circuit;

ii. one or more integrated circuits 32 (ROM chips) for storage of preprogrammed message information;

iii. a digital to analogue a converter—not shown—(-for speech synthesis);

iv. a power supply 30; and v. sound projection/amplification means 38 (i.e., a speaker).

As is generally recognized, readily available components and circuit designs can be combined to provide a sound synthesizer of the type illustrated in FIG. 4. Sound synthesis typically involves the combined effects of various electronic components on an electronic signal. In the case of music synthesizers, the electrical signal undergoes frequency and amplitude shifts to produce discrete musical tones. Electronic synthesis of music can be implemented in various ways utilizing well-known combinations of components in predictive circuit patterns, see for example U.S. Pat. Nos. 4,085,648; 4,080,862; 4,082,027; 4,085,644; and, 4,098,162—all of which are hereby incorporated by reference in their entirety.

A typical electronic configuration, for the synthesis of sound of predetermined tone and predetermined pitch for musical reproduction by the synthesizer assembly of the device of this invention, is illustrated in patents previously incorporated by reference. In the sound synthesizer assembly for the device of this invention, the electrical signal intensity and electrical signal duration are controlled by preprogrammed instructions in the memory of the integrated circuit. In a representative embodiment of this invention, the circuitry of the synthesizer assembly of the device of this invention is preferably configured as a latch circuit. Thus, the integrated circuit of this device controls the amplitude and duration of electronic signal as it pulses through the various components which it controls, and thereafter automatically shut itself off upon detection of the appropriate end-code message. The encoded message may appear after the first complete set of message instructions or can be inserted after one or more repetitions of the preprogrammed message instructions in the synthesis of the musical message.

In a typical and representative embodiment for the synthesis of sound reproduction of predetermined linguistic components of speech, the circuitry illustrated and described in the patents previously incorporated by reference, can be employed; see for example, the circuitry described in either U.S. Pat. Nos. 3,146,309 and 4,266,096 (both of which being hereby incorporated by reference in their entirety). In electronic speech synthesis, the linguistic information codes stored in memory are encoded as digital information and must be converted to an analogue signal in the synthesis of the audible components of speech. This is achieved by well known means (i.e., a digital to analogue converter).

While the invention has been described with reference to the preferred embodiments as illustrated in the accompanying figures, it is recognized by those skilled in the art that modification of the embodiments described herein can be made with departing from the scope or spirit of the invention.

What is claimed is:

1. In a graphic and/or pictorial information communication device having audible enhancement of said graphic and/or pictorial information, the improvement comprising:

an information display member comprising an essentially rigid, substantially circular face member having a convex surface and a concave surface, said convex surface of said member having graphic and/or pictorial information associated therewith;

means for audible enhancement of said graphic and/or pictorial information comprising a sound synthesizer assembly for electronic sound reproduction, said assembly comprising a sound reproduction circuit, means having encoded message information for control of said circuit, a source of electrical power operative with said circuit and manual switching means for energizing said circuit with said source of electrical power;

means for projecting the electronic sound reproduction through said display element; and a backplate comprising an essentially rigid, substantially circular element having an essentially flat surface and means associated therewith for coupling with the back of said display member, thereby defining a chamber for housing the sound synthesizer assembly within said device, said backplate being further provided with means for fastening to apparel.

2. The improved communication device of claim 1 wherein, the backplate is removable.

3. The improved communication device of claim 1 wherein, the backplate is provided with an access window to permit replacement of the source of electrical power.

4. The improved communication device of claim 1 wherein, the means for control of the circuit is removable and can be replaced with another having different encoded message information.

5. The improved communication device of claim 1 wherein, the switching means of synthesizer assembly comprises a membrane switch.

6. The improved communication device of claim 1 wherein, the means for protecting the sound reproduction comprises a speaker element.

7. The improved communication device of claim 1 wherein, the face member of said device displays a political message.

8. The improved communication device of claim 1 wherein, the information associated with the face member of the device can be changed or altered.

9. The improved communication device of claim 1 wherein, the audible output of the synthesizer assembly comprises musical tone.

10. The improved communication device of claim 1 wherein, the audible output of the synthesizer assembly comprises linguistic components of speech.

11. In a graphic and/or pictorial information communication device having audible enhancement of said graphic and/or pictorial information, the improvement comprising:

an information display member comprising an essentially rigid, substantially circular face having a convex surface and a concave surface, said convex surface of said member having graphic and/or pictorial information associated therewith and said member further having one or more perforations;

means for audible enhancement of said graphic and/or pictorial information comprising a sound synthesizer assembly for electronic sound reproduction, said assembly comprising a sound reproduction circuit, means having encoded message information for control of said circuit, a source of electrical power operative with said circuit and manual switching means for energizing said circuit with said source electrical power;

means for projecting the electronic sound reproduction through the perforations in the face of said information display element; and a backplate comprising an essentially rigid, substantially circular element having an essentially flat surface and means associated therewith for coupling with the back of said display member, thereby defining a chamber for housing the sound synthesizer assembly within said device.

12. In a graphic and/or pictorial information communication device having audible enhancement of said graphic and/or pictorial information, the improvement comprising:

an information display member comprising an essentially rigid, substantially circular face member having an interior surface and an exterior surface, said exterior surface of said member having graphic and/or pictorial information associated therewith;

means for audible enhancement of said graphic and/or pictorial information comprising a sound synthesizer assembly for electronic sound reproduction, said assembly comprising a sound reproduction circuit, means having encoded message information for control of said circuit, a source of electrical power operative with said circuit and manual switching means for engaging said circuit electrical power;

means for projecting the electronic sound reproduction through said information display element;

a backplate comprising an essentially rigid, substantially circular element having an essentially flat surface and means associated therewith for coupling with the display member, thereby defining a chamber between the interior surface of said display member and said backplate for housing the synthesizer assembly within said device, said backplate being further provided with means for fastening to apparel.

* * * * *